United States Patent [19]

Mia et al.

[11] 4,320,980

[45] Mar. 23, 1982

[54] MACHINE FOR TYPING CHARACTERS

[75] Inventors: Gian V. Mia, Feletto; Mario Figini, Bosco Marengo, both of Italy

[73] Assignee: Ing. C. Olivetti & C., S.p.A., Ivrea, Italy

[21] Appl. No.: 119,049

[22] Filed: Feb. 6, 1980

[30] Foreign Application Priority Data

Feb. 7, 1979 [IT] Italy ..... 67265 A/79

[51] Int. Cl.[3] ..... B41J 29/36

[52] U.S. Cl. ..... 400/70; 400/144.2; 400/210; 400/696; 400/697.1

[58] Field of Search ..... 400/103–106, 400/210, 70, 144.2, 144.3, 696–697.1

[56] References Cited

U.S. PATENT DOCUMENTS 3,719,262 3/1973 Taplin ..... 400/105

3,868,673 2/1975 Mau, Jr. et al. ..... 340/723 X

*Primary Examiner*—Paul T. Sewell

*Attorney, Agent, or Firm*—Schuyler, Banner, Birch, McKie & Beckett

[57] ABSTRACT

Characters are typed in reverse, i.e. light characters on a dark background by first typing all over the field of the character using an ink ribbon, back spacing and typing the character using a correcting ribbon. The first typing may be effected with a solid character covering the whole field in one or a few operations but, in the preferred embodiment is effected by repeatedly typing a vertical bar with tiny line feed increments, say 1/120". The first typing may take place on depression of a special key, which also effects the back spacing and the correcting ribbon; the character key is then struck. Preferably the whole sequence takes place automatically upon depression of the character key while a mode selector is in REVERSE mode.

23 Claims, 11 Drawing Figures

MACHINE FOR TYPING CHARACTERS

BACKGROUND OF THE INVENTION

The present invention relates to a machine for typing characters on a recording sheet and for emphasising some of the characters. The machine may be a typewriter or another office machine incorporating a typing mechanism.

Typewriters or other typing machines are known, which use two-coloured inked ribbons for typing the characters which are to be emphasised in a different colour from the colour of the remainder of the typing. However, such machines suffer from the disadvantages of the poor-quality typographic appearance of texts which are typed in two different colours and of the loss of the emphasis in black-and-white photocopying.

Also known is the typographic device of forming a background which is of a different colour from the colour of the recording sheet in order to put particular emphasis on some parts of the composed text. This method requires the use of particular typographic procedures (such as photo-composition or the use of a plurality of clichés) which are rather complex and cannot be used on normal typewriters.

The object of the present invention is therefore to provide a machine which enables characters to be clearly emphasised with respect to other parts of the text, while also being of low cost and simple and quick to use.

SUMMARY OF THE INVENTION

According to the present invention, there is provided a machine for typing characters on a recording sheet, comprising a character-carrying member for typing the characters and a device which actuates the character-carrying member for successively printing a contrast sign of the said member and a character which is to be emphasised, for the respective production of a contrasting background on the recording sheet and visualisation of the character clearly on the background.

BRIEF DESCRIPTION OF THE DRAWINGS

The invention will be described in more detail, by way of example, with reference to the accompanying drawing, in which.

FIGS. *7a* to *7d* show different phases in the operations of typing on recording sheets with the typewriter of FIG. 1.

DESCRIPTION OF THE PREFERRED EMBODIMENT

Figure 1:
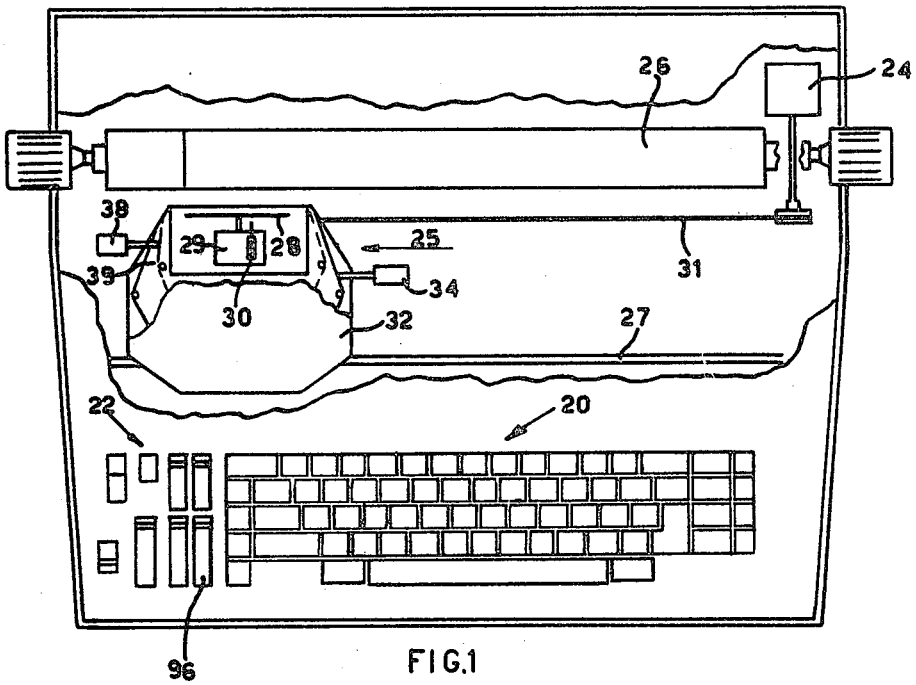
FIG. 1 is a plan view of a typewriter incorporating a first embodiment of the invention.

The typewriter 10 in FIG. 1 is of the type which is described in the specification of U.S. Demonte and Figini Application Ser. No. 58,202, filed July 17, 1979, and assigned to Ing. C. Olivetti & C., SpA which is referred to below as reference 1, and comprises an alpha-numeric keyboard 20, a control console 22, a typing platen 26 and a serial print unit 25. The unit 25 is advanced incrementally and parallel to the roller 26 by a drive motor 24 by means of wires 31 and guides 27. The unit 26 comprises a character-carrying member 28 of the 'daisy wheel' type, which is rotated incrementally by a motor 29 for selecting the 'petal' which carries the symbol to be printed, a striker hammer 30 and a typing ribbon 33 which is carried by a cartridge 32 and which is raised for the printing operation by a solenoid 34. The machine also comprises a correcting ribbon 39 which may either be of the 'cover up' correction type or of the cancellation or 'lift off' type. The ribbon 39 is lifted for the correction operation by a solenoid 38. Details of the mode of operation of the typing and correction ribbons 32 and 39 are outside the present invention and are described in U.S. Falconieri Application Ser. No. 58,201, filed July 17, 1979, and assigned to Ing. C. Olivetti & C., S.p.A. (reference 2).

The control console 22 comprises a selector 96 whose slider can select, besides particular print types such as 'underlining' and 'heavy type', a normal print mode (NORM) and a special print mode in negative form, with a white character on a black background (REVERSE).

The character-carrying member 28 comprises in particular (see FIG. 2) one 'petal' 51 which at the end carries a vertical bar which represents the symbol "|" of U.S. Ser. No. 594,360, filed July 9, 1975, of Giampaolo Guerrini, parent application of U.S. Ser. No. 787,845, filed Apr. 15, 1977, now U.S. Pat. No. 4,236,838, assigned to Ing. C. Olivetti & C., SpA which is normally used in the typewriter of reference 1 for producing tables or for producing 'vertical lining'.

Figure 3:
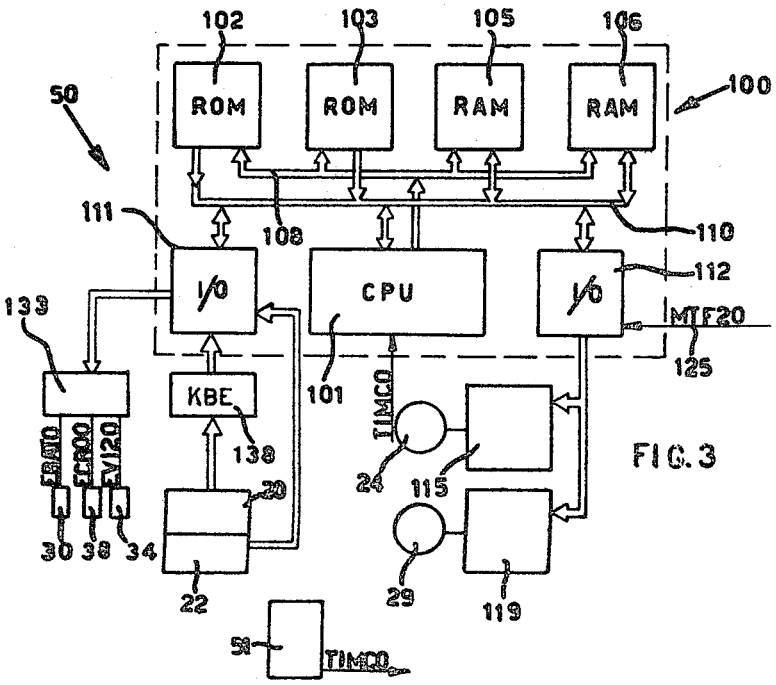
FIG. 3 is a block diagram of a logic unit for controlling the typewriter of FIG. 1.

Referring now to FIG. 3, the machine comprises a control unit 50 of the type described in reference 1. Briefly, the unit 50 comprises a microprocessor 100, two control units 115 and 119 respectively for the drive motor 24 and the selection motor 29, actuating circuits 133 for the hammer 30 and the solenoids 34 and 38, a time-delay unit 51, the control console 22 and a keyboard encoder (KBE) 138.

The microprocessor 100 which is of known type is for example of the type described in U.S. Pat. No. 4,114,026 assigned to Ing. C. Olivetti & C. SpA and comprises a central unit (CPU) 101; a ROM 102 and a ROM 103 storing the sequences of micro-instructions, two working RAM memories 105 and 106 which are used for the temporary storage of the data and two input/output (I/O) units 111 and 112 for the exchange of data and commands with logic units 115, 119, 133, 138 and 22. The memories 102, 103, 105 and 106 are connected to the CPU 101 by an address bus 108 and a data exchange bus 110.

As already described in reference 1, the logic unit 115 and the motor 24 are operable to impart elementary movements to the print unit 25 down to a minimum value of 1/360" (0.07 mm).

Figure 4:
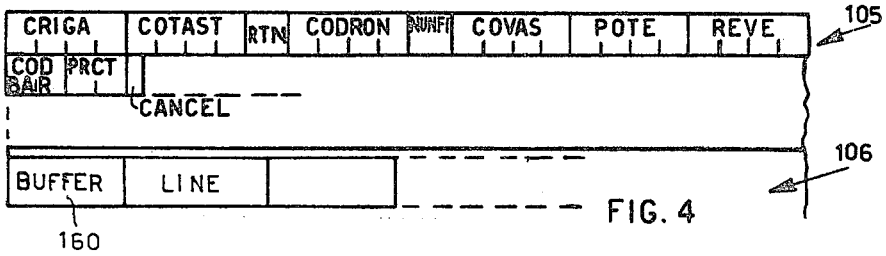
FIG. 4 is a diagrammatic view showing the memory organisation of the logic unit.

The memories 105 and 106 include a line buffer 160 (FIG. 4) having the capability of memorising 256 character positions. The buffer memorizes the codes of the symbols which are introduced by the keyboard and which are printed or in the process of being printed by the machine in the line of typing in the course of setting up.

Figure 5:
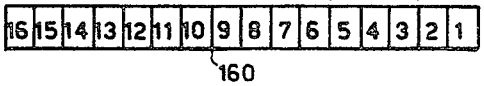
FIG. 5 shows the bit organisation of characters in a line buffer forming pair of the memory.

Each character position 160*a* of the buffer 160 is formed by sixteen bits having the following significance (FIG. 5):

bit 9=1 indicates that the character is underlined;
bit 10=1 indicates that the character is in heavy type;
bit 11=1 indicates that the character is in an overlapping relationship with the following character;
bit 12=1 indicates that the character is a space;
bit 13=1 indicates that the character is to be printed in the REVERSE mode and is set at 1 upon keyboard input into the buffer 160 of the character code if the selector 96 is set at REVERSE;
bits 14–16 indicate in binary coding the number of increments of 1/60" (0.4 mm) by which the head must be spaced after having effected printing of the character in order to move to the position required for printing of the following character.

As already described in reference 1, the typewriter is capable of printing either with a constant spacing of 1/10", 1/12" and 1/15", (2.5 mm, 2.1 mm or 1.7 mm) or with proportional spacing (PS) which can be selected by means of a selector 80 on the console 22. In proportional spacing, associated with each character is a width or spacing of form 4/60" to 7/60", (4 to 7×0.4 mm), referred to as 4 to 7 increments. In order to centre each character in the space which is available thereto, after printing of a character, the head performs a movement equal to the spacing associated with the character. If the following character to be printed has an associated spacing of 4 or 5 increments, the carriage is in position and printing can occur. On the other hand, the carriage advances by 5 and 6 increments respectively before the printing operation, if the following character to be printed has an associated spacing of 6 or 7 increments. In the latter case moreover, after printing the character, the head will perform an advance movement equal to the spacing of the last character printed reduced by the space of one increment effected before the print. Bits 14–16 of each character position represent precisely the effective movement which the print unit must perform after printing the character.

The memories 105 and 106 also comprise all the temporary memory cells for the data required for controlling the operations of the machine, which are used by the control programs stored in the ROMs 102 and 103. For the purposes of the present invention, the following cells are mentioned:

CRIGA: BUFFER POINTER contains the address of a cell of the buffer 160;
BUFFER: cell of the buffer 160 addressed by the pointer CRIGA;
COTAST: 16 bit cell operable for temporary storage of the content of a cell of the buffer 160;
RETN: 4 bit cell used as a counter for dead characters associated or overlapped with a character with spacing;
CODRON: 16 bit memory in which is contained information required for the printing and the spacing of the character whose code is memorized in COTAST; in particular, bits 13, 14 and 15 indicate the spacing associated with the character whose code is specified by bits 1–8 of COTAST;
NUNFI: 4 bit memory operable to memorize the spacing associated with the character to be printed in reverse;
COVAS: 16 bit memory for calculating the movements of the head expressed in the number of 1/60" (0.4 mm) increments;
POTE: 16 bit memory which memorizes the number 1/60" (0.4 mm) increments by which the head is spaced from the extreme left-hand margin of the machine;
REVE: 16 bit memory used for memorizing positions of the print unit expressed in 1/60" (0.4 mm) increments with respect to the extreme left-hand margin during printing a character in the reverse mode;
CODBAR: 8 bit memory which stores the code of the character "|";
PRCT: 8 bit memory which stores the code of the character to be printed and which is used by the print sub-routines STP; and
CANCEL: 1 bit flag which is used by the routine STP.

The programs for controlling the various operations of the machine, memorized in the ROM 102 and 103, are described in reference 1. The following sub-routines are emphasized for the purposes of the present invention:

INDI: which performs a rearward movement of the print unit 25 by the number of 1/60" (0.4 mm) increments memorised in COVAS;
AVA: which performs a forward movement of the unit 25 by the number of 1/60" (0.4 mm) increments memorised in COVAS;
AV 1/120: which performs the forward movement of the unit 25 by 1/120" (0.2 mm); and
STPAVN: performs normal printing of the character code stores in the bits 1–8 of the cell of the buffer 160 pointed to by CRIGA and effects the successive advance movement of the unit 25 by the number of 1/60" (0.4 mm) increments indicated by the bits 14–16 of the cell.

The routine STP performs without advance movement:

(a) selection on the character-carrying member 28 of the character corresponding to the code stored in PRCT, by means of rotation of the shaft of the motor 29;

(b) lifting for the printing operation the typing ribbon 33 by energisation of the solenoid 34 when the CANCEL flag is 0 or, alternatively, lifting the correcting ribbon 30 by energization of the solenoid 38 when the CANCEL flag is 1;

(c) finally, energisation of the hammer 30 with printing of the character memorized in PRCT, in the positive or the negative mode according to the ribbon lifted.

Figure 6:
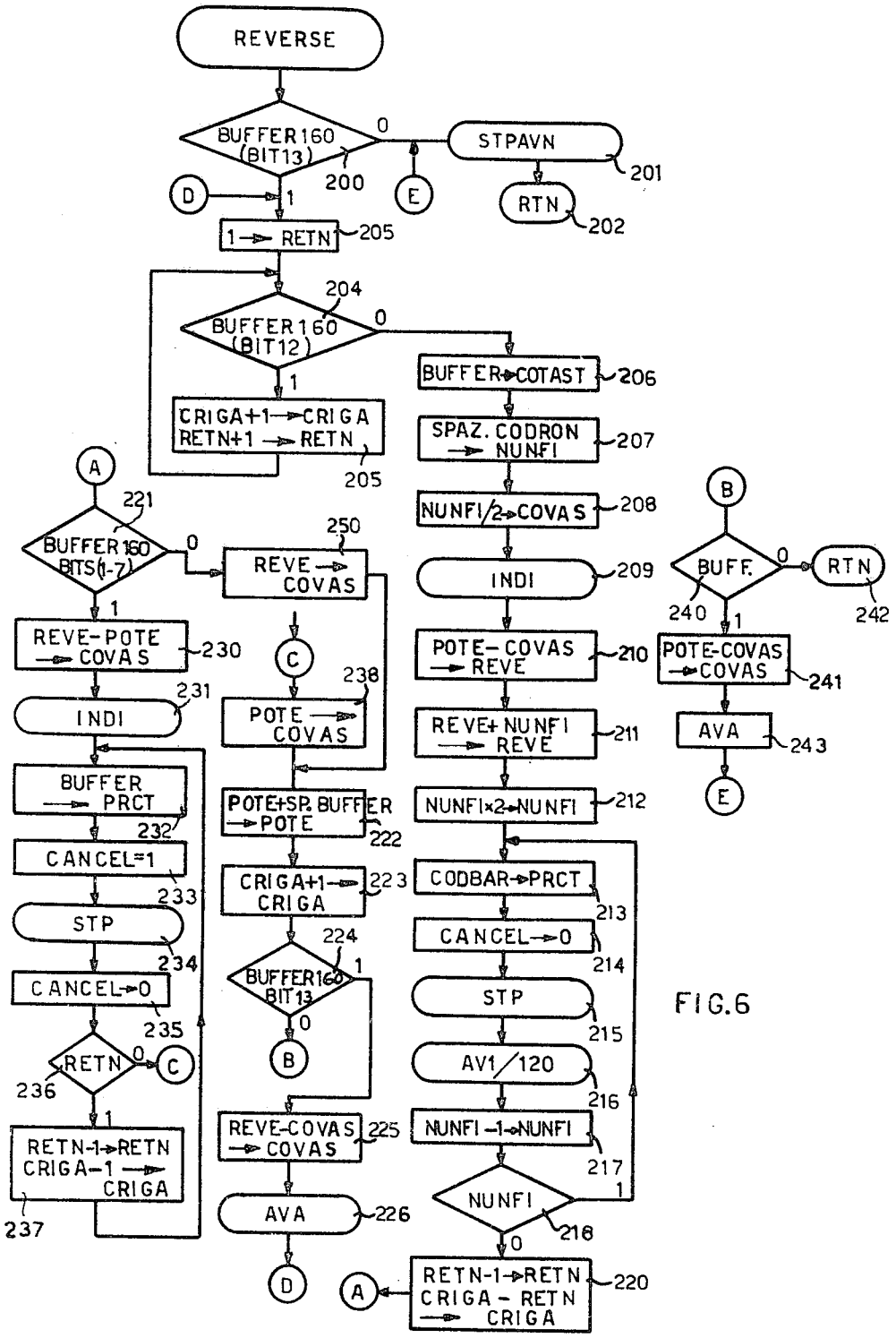
FIG. 6 is a flow chart illustrating the operations of the typewriter of FIG. 1.

Performance of the REVERSE mode printing is performed by means of the print routine STP RV whose flow chart is shown in FIG. 6. The routine STP RN is performed whenever printing of a character is effected, whose code is stored in the cell of the buffer 160 pointed to by the buffer pointer CRIGA, and the print unit 25 is already in the precise printing position as stored in POTE.

The sub-routine STP RV begins with examination (decision 200) of the bit 13 of the BUFFER cell; if the selector 96 is not in the REVERSE position, the bit 13=0 (NO output of the decision 200) and the character stored in the buffer is to be printed in the normal mode and sub-routine STP AVN (block 201) is performed, followed by return to the main control program (RTN). If however the selector 96 is in the REVERSE position, the bit 13 of BUFFER=1 (YES output of the decision 200), the character is to be printed in the reverse mode and 1 is entered in the counter RETN (block 203).

Then, (decision 204), the bit 12 of the BUFFER cell is investigated to determine if the character to be printed is a dead character (without spacing). In the affirmative situation (bit 12=1: YES output of the decision 204), either the counter RETN or the buffer pointer CRIGA (block 205) are incremented by one; the following cell of the buffer 160 is therefore addressed and the sequences of the decision 204 and the block 205 are repeated until the BUFFER cell addressed by CRIGA does not contain information relating to the live character (with spacing bit 12=0) with which the previous dead characters are associated. At the end of the loop 204, 205, (NO output of decision 204), the counter RETN therefore stores the number of characters which must be printed in an overlapped condition in the print position in which the head is positioned.

Figure 7A:
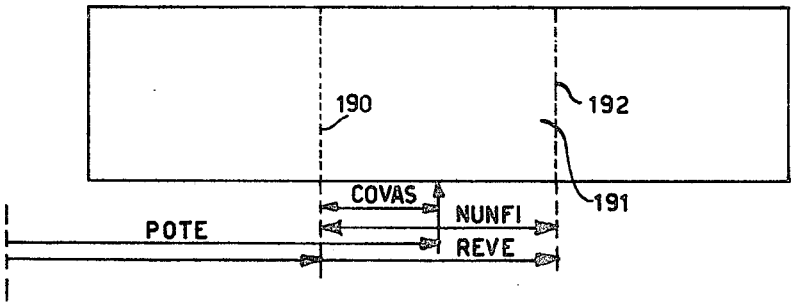

When the BUFFER cell stores information of a live character (NO output of decision 204), such information is transferred into COTAS (block 206) and therewith all the information relating to printing of the character is provided in the CODRON cell. In particular, the spacing associated with the character (bits 13–15 of CODRON) is stored in the NUNFI cell (block 207) and such spacing, divided by two with rounding off, is stored in COVAS (208). Sub-routine INDI (block 209) is then performed which, by virtue of the value of COVAS, moves the print unit 25 rearwardly until it has been moved to the initial margin 190 (FIG. 7*a*) of the print area 191 of the character.

Figure 7B:
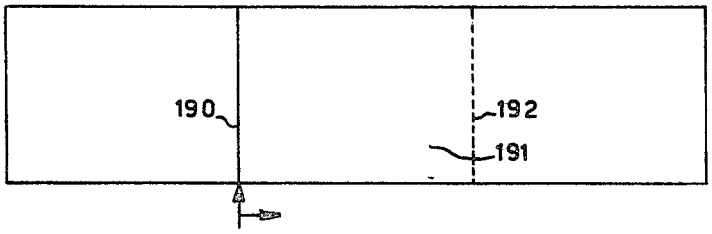

Calculation of the position relative to the final margin 192 of the print area of the character is then effected (POTE−COVAS+NUNFI) and the result is stored in the REVE cell (FIG. 6, blocks 210 and 211). By multiplying the content of NUNFI by two (block 212), the valve of the spacing of the character to be printed is determined in units of 1/120" (0.2 mm) and the value is also stored in NUNFI. The content of the cell CODBAR is then stored in the cell PRCT, that is to say, the code of the character "|", the vertical bar 52 (block 213); the sub-routine STP is then performed with the CANCEL flag at 0 (blocks 214 and 215) and, subsequently, the sub-routine AV 1/120 (block 216). In this way, the unit 25 produces typing of the character "|" by means of the typing ribbon and then advances by units of 1/120" (0.2 mm) (FIG. 7*b*).

Figure 7C:
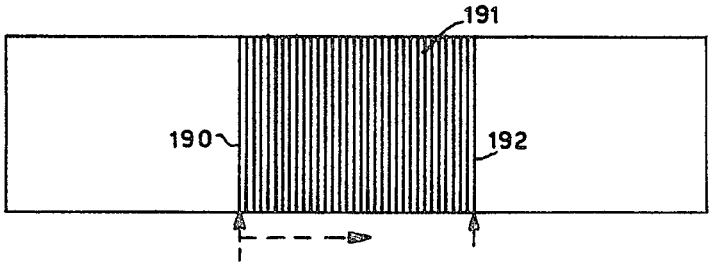

Thereupon, the value contained in the cell NUNFI (FIG. 6) is decremented by one unit, with verification if that value after the decrement is equal to zero (block 217, decision 218). If such verification is negative (NO output of the decision 218), the sequence of instructions thereof to the blocks 213 to 217 is repeated for a number of times equal to the number required to adjust the content of NUNFI to zero. It follows therefrom that, at the end of that repeated sequence (NUNFI=0), the print area of the character will be entirely occupied by characters "|" or 52, spaced from each other by 1/120" (0.2 mm), which spacing, in view of the width of the vertical bar, is not sufficient to distinguish a bar from the adjacent bar; thus, a background of the same colour as the typing ribbon, for example black as in FIG. 7*c*, is thus produced in the print area, with the print unit 25 positioned at the end 192 of the print area 191. The bars are separately distinguished in FIG. 7*c* for illustrative purposes.

Figure 7D:
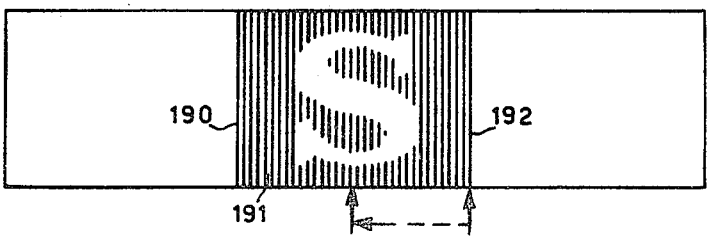

When verification by the decision 218 (FIG. 6) is positive (NUNFI=0), the counter RETN is decremented by 1 and the buffer pointer CRIGA is updated (so that it points to the cell of the buffer 160 which stores the code of the first character (dead or alive according to whether RETN=0 or not) to be printed in contrast on the black background of the print area in question (block 220). It is also determined (decision 224) whether the character indicated is a space (bits 1–7=0) and in the negative situation (NO output) the difference between the actual position of the head (REVE) and the position required for centering the striker hammer in the print position (POTE) (block 230) is stored in COVAS, and then the sub-routine INDI (block 231) is performed, which returns the print unit rearwardly, being centered for the print operation (FIG. 7*d*).

The code of the character to be printed is transferred from the indicated BUFFER cell to the cell CPRT (block 232) while the CANCEL flag is set at 1 (block 233), thus selecting the correcting ribbon 30. Subsequent performance of the subroutine STP (block 234) causes printing of the character whose code is stored in CPRT by means of the correcting ribbon 30. When the machine uses a ribbon of the 'lift off' type, that will cause removal of the background portions corresponding to the character to be emphasised. When the correcting ribbon is of the 'cover up' type, the pigments of that ribbon will be superimposed on the background. Consequently, in either case, the printed character will appear in negative form, contrasting on the background and centered on the background itself. The CANCEL flag is then set to zero (block 235) and the arrangement checks (decision 236) if the counter RETN is equal to 0, that is to say, if, in the print position in question, a single live character is printed (that which has already been printed).

In the negative case, that is to say, when the printed character is dead, and is associated with possible other dead characters and with a live character which is still to be printed, the counter RETN is decremented by one unit and the buffer pointer CRIGA is incremented by one unit (block 237). It thus points to the next following BUFFER cell, containing the code of a fresh character to be printed, and the sequence of blocks 231–234 is repeated for reverse printing of that fresh character which is superimposed on the first. Similarly, the sequence of the blocks 231–236 is repeated until the detection operation performed by the decision 235 does not confirm that RETN=0 and reverse printing of all the characters in a superimposed position is effected, in the print position in question.

When RETN=0 (YES output of the decision 236, points C), the content of the cell POTE is transferred to COVAS (block 238) and the content of the cell POTE is incremented (block 222) by the value of the spacing to be effected after printing the last character and stored in the bits 13–15 of the BUFFER (SP. BUFFER). In addition, the pointer CRIGA is incremented by one unit (block 223) and thus points to the BUFFER cell in which the code of the character to be printed in the following print position is stored; the bit 13 of that indicated character is then examined (decision 224). If the selector 96 has not been moved, the next character is also to be printed in the REVERSE mode (bit 13=1). In that case (output YES of the decision 224), the result of the difference between the contents of REVE and COVAS is stored in COVAS (block 225), that is to say, the number of increments of 1/60" (0.4 mm) by which the print unit must move in order to go to the beginning 190 of the print area 191 of the next character for forming the background in that print area. The routine AVA is then performed, which causes the print unit 25 to advance to the zone entry position (block 226). The instructions of the sub-routine STPRV are then performed again, from the block 203 (point D).

If however the selector 96 of the console 22 has been switched from the reverse position, the result of operation of the decision 224 is negative (NO output) and thus the next character is not printed in reverse, and in that case the arrangement determines if the BUFFER cell indicated is empty (decision 240); in the affirmative case (output YES), there being no character to be printed, the sub-routine has been concluded and returns (block 202) to carrying out the other control programs RTN. If the BUFFER cell is not empty (decision 240 output NO), the number of steps of 1/60" (0.4 mm) by which the print unit 25 must advance in order to go to the position of printing the following character stored in the BUFFER (POTE-COVAS) is stored in COVAS (block 241). The routine AVA is then performed, which advances the print unit 25 into the strike position (block 243) and it finally jumps to carrying out the routine STPAVN (block 201) for printing the character in the normal manner.

If finally examination of bits 1–7 of the BUFFER cell, by means of the above-described decision 220, is positive, that is to say, when the character to be struck in the REVERSE mode is a space (output YES), this indicates that, since the print operations which contributed to forming the background (blocks 213–220), there is no wish for any character to be produced in the print area in question. The head is already at the beginning of the following print area, whereby the content of REVE is stored in COVAS (block 250) and then the instructions described above with reference to blocks 222–226 and 240–243 are then carried out. Consequently, the print unit 25 remains in its current position ready for forming the background in the following print area, if the next character is to be printed in the REVERSE mode, with the subroutine STPRV being performed again starting from point E; if however the next character is to be printed in the normal way, the print unit 25 is advanced until it is in the print position associated with that character.

Among many possible modifications we mention the following: Firstly, the formation of the background may be effected by one or more 'full' characters of the character-carrying member, the width of which is equal to the width of the space associated with the character to be emphasised. An example of a full character of this kind is to be found in Italian Pat. No. 889,086 and in that case a single typing cycle is sufficient to produce the background.

Secondly, the background may be formed by using characters other than the vertical bar and/or different cycles of advance movement of the typing point. By way of example, it is possible to use the underlining symbol "_". In that case, there is no need for any horizontal movement of the character-carrying member and the background is formed by repeating printing of the sign after repeated elementary rotations of the typing platen 26.

Besides electronically controlled machines, the invention can also be easily applied to mechanical or electrical typewriters which are provided with a correcting device. By way of example, reference may be made to a machine of the type described in our Italian patent application No. 68019-A/76.

It is sufficient for that machine to be provided with a full character which can be selected for forming the background. The characters are emphasised on the background, by printing them after selection of the correction device. For carrying out the various operations in succession, while using the minimum possible number of keys of the machine keyboard, the machine is provided with a key 800 (FIG. 8) which prints a full character 801 without any advance movement, and presets a correction cycle in respect of the character to be emphasised which, in contrast to the correction cycles which can be selected by the correction key of the machine, is followed by an advance movement of the typing point.

Figures 2, 8:
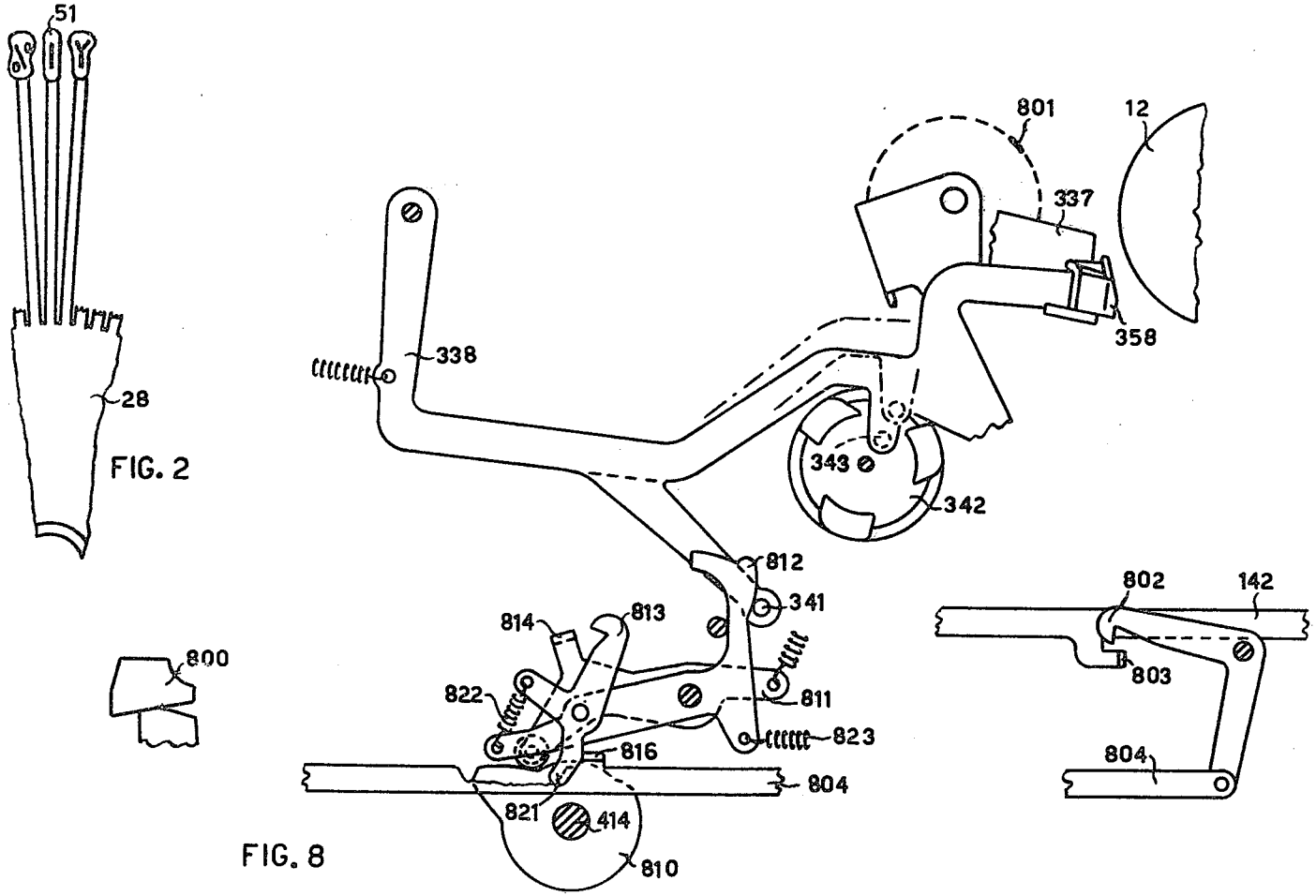
FIG. 2 is a detail of the typing mechanism of the typewriter.
FIG. 8 is a diagrammatic view of a modified embodiment of the invention.

In particular, by using essentially FIG. 2 of the above-mentioned Italian patent application No. 68019-A/76, with the same numbering, the machine is provided with a presetting cam 810 which co-operates with a cam follower 811. The forked member 338 which lifts the correcting ribbon 358 co-operates by means of its pin portion 341 with a further positioning means which is substantially the same as that for the correction cycle (not shown in the drawings). Pivoted on the positioning means 812 is a pawl member 813 arranged to co-operate with a limb portion 814 of the cam follower 811. The key 800, by means of a connecting rod 804, interposes a stop member 802 into the path of movement of a limb portion 803 of the spacing actuating member 142. In turn, a limb portion 816 of the connecting rod 804 acts on an arm portion 821 of the pawl member 813, causing the pawl member 813 to be engaged with the cam follower 811, by means of a spring 822.

Actuation of the key 800 prevents advance movement of the typing point after printing of the full character 801, which is effected by means of the normal typing ribbon 337. In addition, almost at the end of the print cycle, a high lobe of the cam 810 causes pivotal movement of the cam follower 811 in the clockwise direction and consequential entrainment of the positioning means 812 which moves the forked member 338 for lifting the correcting ribbon in the position of predisposition for the correction operation into the position shown in dash-dotted line. The pin portion 343 of the forked member 338 in that case remains in the path of movement of the lobes of the correction cam 342.

When now any typing key is depressed, by the action of the cam 342 on the pin portion 343, in addition to the inked ribbon 337, the correcting ribbon 358 is also lifted, which cuases cancellation or cover-up of the background portion corresponding to the character which is to be emphasised, in the manner described in above-mentioned patent application No. 68019-A/76. The lifting movement of the forked member 338 in turn causes liberation of the positioning means 812 which returns to its rest position under the action of its spring 823. In addition, as the positioning means 812 is not connected to any escapement-preventing mechanism, the typing point advances regularly and typing a following character in the reverse mode may be effected by sequentially repeating actuation of the key 800 and one of the typing keys.

What we claim is:

1. A machine for typing characters on a recording sheet, comprising a character-carrying member for typing the characters on typing areas of the sheet and a device for actuating the character-carrying member for successively printing a contrast sign of the said member and a character which is to be emphasized, for the respective production of a contrasting background on the typing area of the recording sheet, contrasting with respect to the background of the sheet, and visualization of the character clearly on the contrasting background of said typing area.

2. A machine according to claim 1, comprising a first mechanism for selecting a typing ribbon for forming the contrasting background and a second mechanism for selecting another ribbon for emphasising the character.

3. A machine according to claim 2, wherein the said device selects a predetermined element of the said member for forming the contrasting background and comprises a selector which is actuable for presetting actuation of the first mechanism and actuation of the predetermined element.

4. A machine according to claim 3, wherein the selector also presets actuation of the second mechanism in response to actuation of the typing member for typing the character.

5. A machine according to claim 2, comprising a control member for actuating a mechanism for advancing the typing point of the machine, for advancing the typing point only after the contrasting background has been produced and the character which is to be emphasized has been printed.

6. A machine according to claim 1, further comprising a mechanism for producing said contrasting background in different width, whose value is determined by the width of the character to be emphasized.

7. A machine according to claim 1, further comprising a mechanism for producing the contrast background in a plurality of successive and adjacent prints of the contrast sign of said character-carrying member.

8. A machine according to claim 1, further comprising an electronic unit which sequentially actuates production of the contrast background and visualization of the character to be emphasized.

9. A machine according to claim 1, wherein said contrast background covers substantially the whole surface of the typing area.

10. A machine according to claim 1, wherein said contrast background covers partially said typing area through interleaved parallel contrast bands.

11. A machine for typing characters on a recording sheet, comprising a character-carrying member for typing the characters and a device which actuates the character-carrying member for successively printing a contrast sign of the said member and a character which is to be emphasized, for the respective production of a contrasting background on the recording sheet and visualization of the character clearly on the background wherein said device comprises a mechanism for correction which makes visual the character to be emphasized, by means of one of covering up and lifting off of the parts of the contrasting background corresponding to the character to be emphasized.

12. A machine according to claim 11, wherein said correction is effected by removal of said parts.

13. An electronic typewriter comprising a unit for the input of the characters to be typed, a unit for dark typing the characters on typing areas of a sheet, a device for correction of the typed characters, and a device for typing in a reverse mode which responds to the inputted character for sequentially actuating the typing unit for producing a contrasting dark background on a selected typing area of the sheet larger than the surface of the inputted character, and the correction device for cancellation or correction of the parts of the background of said selected typing area which correspond to the surface of the inputted character to emphasize said inputted character on the sheet light with respect to the dark background.

14. A machine according to claim 13, wherein the input unit comprises an alpha-numeric keyboard and the device for typing in the reverse mode comprises a selector which causes the characters introduced by the keyboard to be typed in the reverse mode so long as the selector is in a reverse mode.

15. A machine according to claim 13, wherein the typing unit comprises a character-carrying member and the dark background is formed by printing a predetermined sign of the character-carrying member.

16. A machine according to claim 15, wherein said sign causes the typing of a dark band whose width is less than the width of the inputted character, further comprising spacing means actuatable upon the typing of said sign in the reverse mode for spacing said character carrying member through a space less than the width of said inputted character and a control unit which repeats the printing of the sign until a background of width sufficient for the inputted character to be emphasized has been formed.

17. A machine according to claim 15, comprising a memory for storing a number associated with the width of the character to by typed in the reverse mode, a spacing member which causes the typing point to advance by multiples of elementary units after printing of the said sign, and wherein the control unit repeats the printing of the said sign a number of times which is proportional to the number stored in the memory.

18. A machine according to claim 17, wherein the spacing member causes the typing point to advance to a predetermined distance from an edge of the last character typed, and wherein the control unit causes the typing point to move rearwardly to print the said sign near the said edge.

19. A machine according to claim 17, wherein the control unit visualizes the character to be typed in the reverse mode, centered with respect to the background.

20. A machine according to claim 14, wherein the said sign comprises a vertical bar and the said mechanism causes the typing point to advance by a minimum pre-established step and repeats the printing of the bar a number of times which is proportional to the width of the background.

21. A machine according to claim 13, wherein the advance movement of the typing member is less than the width of the printed sign, thereby to produce a substantially uniform background.

22. An electronic typewriter comprising a character-bearing element, input means for the input of data characters to be typed, a printing ribbon, electronic control means responsible to said data for actuating the character-bearing element to serially select said characters and type each selected character on a recording medium through said printing ribbon, a correcting ribbon, a device for optically cancelling the typing characters from the recording medium by means of a superimposed retyping of the previously typed characters through said correcting ribbon and a device for emphasizing the characters in a reverse mode including:

a selector actuatable in a reverse mode for selecting a reverse mode of the typewriter wherein each input of data is stored and recognized as relative to a character of a predetermined width to be typed in the reverse mode on a given printing point;

typing means for typing a predetermined sign of the character-bearing element on said medium through said printing ribbon and shifting said character-bearing element through an increment small with respect to the width of said emphasized character;

means for repeating the type of said sign and the shift of said character-bearing element adjacently to said printing point to obtain a typed area on said recording medium larger than the width of the emphasized character;

means actuating the character-bearing element to select the character associated to the stored data; and means for typing the selected character through said correcting ribbon on said typed area for optical correcting on said typed area the parts corresponding to the character to be emphasized.

23. A machine according to claim 22, wherein said electronic control means causes the character-bearing element to advance to a predetermined distance from an edge of the last character typed, wherein the typing means causes the character-bearing element to move rearwardly to print the said sign near the said edge, and wherein the means for typing the selected character visualizes the character to be typed in the reverse mode, centered with respect to the typed area.

* * * * *